US010943523B2

(12) United States Patent
Chen

(10) Patent No.: US 10,943,523 B2
(45) Date of Patent: Mar. 9, 2021

(54) DRIVING METHOD OF DISPLAY PANEL AND DISPLAY DEVICE

(71) Applicants: HKC Corporation Limited, Guangdong (CN); Chongqing HKC Optoelectronics Technology Co., Ltd., Chongqing (CN)

(72) Inventor: Yu-Jen Chen, Chongqing (CN)

(73) Assignees: HKC CORPORATION LIMITED, Shenzhen (CN); CHONGQING HKC OPTOELECTRONICS TECHNOLOGY CO., LTD., Chongqing (CN)

( * ) Notice: Subject to any disclaimer, the term of this patent is extended or adjusted under 35 U.S.C. 154(b) by 0 days.

(21) Appl. No.: 16/612,066

(22) PCT Filed: Jul. 4, 2017

(86) PCT No.: PCT/CN2017/091642
§ 371 (c)(1),
(2) Date: Nov. 8, 2019

(87) PCT Pub. No.: WO2018/205396
PCT Pub. Date: Nov. 15, 2018

(65) Prior Publication Data

US 2020/0168145 A1 May 28, 2020

(30) Foreign Application Priority Data

May 10, 2017 (CN) ..... 2017 1 0329661

(51) Int. Cl.
*G09G 3/20* (2006.01)

(52) U.S. Cl.
CPC ..... *G09G 3/2074* (2013.01); *G09G 3/2003* (2013.01); *G09G 2300/0426* (2013.01);
(Continued)

(58) Field of Classification Search
CPC ..... G09G 3/2074; G09G 3/2003; G09G 2300/0452
See application file for complete search history.

(56) References Cited

U.S. PATENT DOCUMENTS

2009/0167734 A1 7/2009 Chian-Hung et al.
2013/0271504 A1 10/2013 Kim et al.

FOREIGN PATENT DOCUMENTS

CN 1870122 A 11/2006
CN 102254535 A 11/2011
(Continued)

*Primary Examiner* — Kent W Chang
*Assistant Examiner* — Chayce R Bibbee
(74) *Attorney, Agent, or Firm* — Muncy, Geissler, Olds & Lowe, P.C.

(57) ABSTRACT

A driving method of display panel includes: dividing pixels with same one color on the display panel into sets of pixel pairs, each set including a first subpixel and a second subpixel; displaying each frame using two frame images in order; obtaining a first voltage signal and a second voltage signal, a positive-viewing-angle mixed brightness of the subpixel being equivalent to a positive-viewing-angle brightness of the subpixel; driving the first subpixel of the first frame image by the first voltage signal of the first or second subpixel, and driving the second subpixel by the second voltage signal of the first or second subpixel; and driving the first subpixel of the second frame image by the second voltage signal of the first or second subpixel, and driving the second subpixel of the second frame image by the first voltage signal of the first or second subpixel.

17 Claims, 5 Drawing Sheets

(52) U.S. Cl.
CPC ..... *G09G 2300/0452* (2013.01); *G09G 2320/0242* (2013.01); *G09G 2320/0626* (2013.01)

(56) References Cited

FOREIGN PATENT DOCUMENTS

| | | | |
|---|---|---|---|
| CN | 106531103 | A | 3/2017 |
| CN | 106531104 | A | 3/2017 |

DRIVING METHOD OF DISPLAY PANEL AND DISPLAY DEVICE

CROSS REFERENCE TO RELATED APPLICATIONS

This Non-provisional application claims priority under 35 U.S.C. § 119(a) on Patent Application No(s). 201710329661.2 filed in People's Republic of China on May 10, 2017, the entire contents of which are hereby incorporated by reference.

BACKGROUND

Technology Field

This disclosure relates to the technical field of a display, and more particularly to a driving method of a display panel and a display device.

Description of Related Art

A negative type vertical alignment (VA) liquid crystal or an in-plane switching (IPS) liquid crystal technology is adopted in most of current large size LCD display panels. Compared with the IPS liquid crystal technology, the VA liquid crystal technology has the advantages of the higher production efficiency and the low manufacturing cost. Compared with the IPS liquid crystal technology, however, the optical property of the VA liquid crystal technology has the more obvious optical defects. More particularly, the large size panel needs the larger viewing angle for presentation in the commercial application.

The VA liquid crystal drive has the brightness rapidly saturates with the voltage at the large viewing angle, thereby causing the seriously deteriorated quality in the viewing-angle quality contrast and color shift as compared with the front-viewing quality.

SUMMARY

According to various embodiments of this disclosure, a driving method of a display panel and a display device are provided.

A driving method of a display panel comprises: dividing pixels with same one color on the display panel into a plurality of sets of pixel pairs, wherein each of the sets of the pixel pairs comprises a first sub-pixel and a second sub-pixel neighboring upon the first sub-pixel; displaying each frame using two frame images in order, wherein the two frame images comprise a first frame image and a second frame image; obtaining a first voltage signal and a second voltage signal, which correspond to each of the sub-pixels and are unequal to each other, according to a frame input signal and a predetermined rule, wherein the first voltage signal and the second voltage signal alternately drive a positive-viewing-angle mixed brightness of the sub-pixel to be equivalent to a positive-viewing-angle brightness of the sub-pixel driven by the frame input signal; and driving the first sub-pixel of the first frame image by the first voltage signal of the first sub-pixel or the second sub-pixel, and driving the second sub-pixel of the first frame image by the second voltage signal of the first sub-pixel or the second sub-pixel; driving the first sub-pixel of the second frame image by the second voltage signal of the first sub-pixel or the second sub-pixel, and driving the second sub-pixel of the second frame image by the first voltage signal of the first sub-pixel or the second sub-pixel.

A display device comprises: a display panel, a control member and a driving member. The same one color pixel on the display panel is divided into a plurality of sets of pixel pairs, and each of the sets of the pixel pairs comprises a first sub-pixel and a second sub-pixel. The control member is for displaying each frame using two frame images in order, wherein the two frame images comprise a first frame image and a second frame image; and further for obtaining a first voltage signal and a second voltage signal, which correspond to each of the sub-pixels and are unequal to each other, according to a frame input signal and a predetermined rule, wherein the first voltage signal and the second voltage signal alternately drive a positive-viewing-angle mixed brightness of the sub-pixel to be equivalent to a positive-viewing-angle brightness of the sub-pixel driven by the frame input signal. The driving member is connected to the control member and the display panel, is for driving the first sub-pixel of the first frame image by the first voltage signal of the first sub-pixel or the second sub-pixel and driving the second sub-pixel of the first frame image by the second voltage signal of the first sub-pixel or the second sub-pixel, and is further for driving the first sub-pixel of the second frame image by the second voltage signal of the first sub-pixel or the second sub-pixel and driving the second sub-pixel of the second frame image by the first voltage signal of the first sub-pixel or the second sub-pixel.

A driving method of a display panel comprises: dividing pixels with same one color on the display panel into a plurality of sets of pixel pairs, wherein each of the sets of the pixel pairs comprises a first sub-pixel and a second sub-pixel neighboring upon the first sub-pixel; and the first sub-pixel and the second sub-pixel are disposed in the same row and neighbor upon each other, or the first sub-pixel and the second sub-pixel are disposed in the same column and neighbor upon each other; displaying each frame using two frame images in order, wherein the two frame images comprise a first frame image and a second frame image; obtaining a first voltage signal and a second voltage signal, which correspond to each of the sub-pixels and are unequal to each other, according to a frame input signal and a predetermined rule, wherein the first voltage signal and the second voltage signal alternately drive a positive-viewing-angle mixed brightness of the sub-pixel to be equivalent to a positive-viewing-angle brightness of the sub-pixel driven by the frame input signal; driving the first sub-pixel of the first frame image by the first voltage signal of the first sub-pixel or the second sub-pixel, and driving the second sub-pixel of the first frame image by the second voltage signal of the first sub-pixel or the second sub-pixel; and driving the first sub-pixel of the second frame image by the second voltage signal of the first sub-pixel or the second sub-pixel, and driving the second sub-pixel of the second frame image by the first voltage signal of the first sub-pixel or the second sub-pixel.

In the above-mentioned driving method and display device, the pixels with same one color on the display panel are divided into a plurality of sets of pixel pairs. Each frame is displayed using two frame images in order. A low first voltage signal and a high second voltage signal, which correspond to each of the sub-pixels, are obtained according to a frame input signal and a predetermined rule, wherein the first voltage signal and the second voltage signal alternately drive a positive-viewing-angle mixed brightness of the sub-pixel to be equivalent to a positive-viewing-angle brightness of the sub-pixel driven by the frame input signal. The first sub-pixel and the second sub-pixel of the first frame image are respectively driven by a high voltage signal and a low voltage signal, and the first sub-pixel and the second sub-pixel of the second frame image are correspondingly driven by a low voltage signal and a high voltage signal. The color difference drawback caused by the mismatch of the refractive index of the display panel at the large viewing angle can be improved, and this disclosure is particularly applicable to the TN, OCB, and VA type liquid crystal display panels. The processes of this method are simple, and the production yield is high.

BRIEF DESCRIPTION OF THE DRAWINGS

The disclosure will become more fully understood from the detailed description and accompanying drawings, which are given for illustration only, and thus are not limitative of the present disclosure, and wherein.

DETAILED DESCRIPTION OF THE DISCLOSURE

Figure 1:
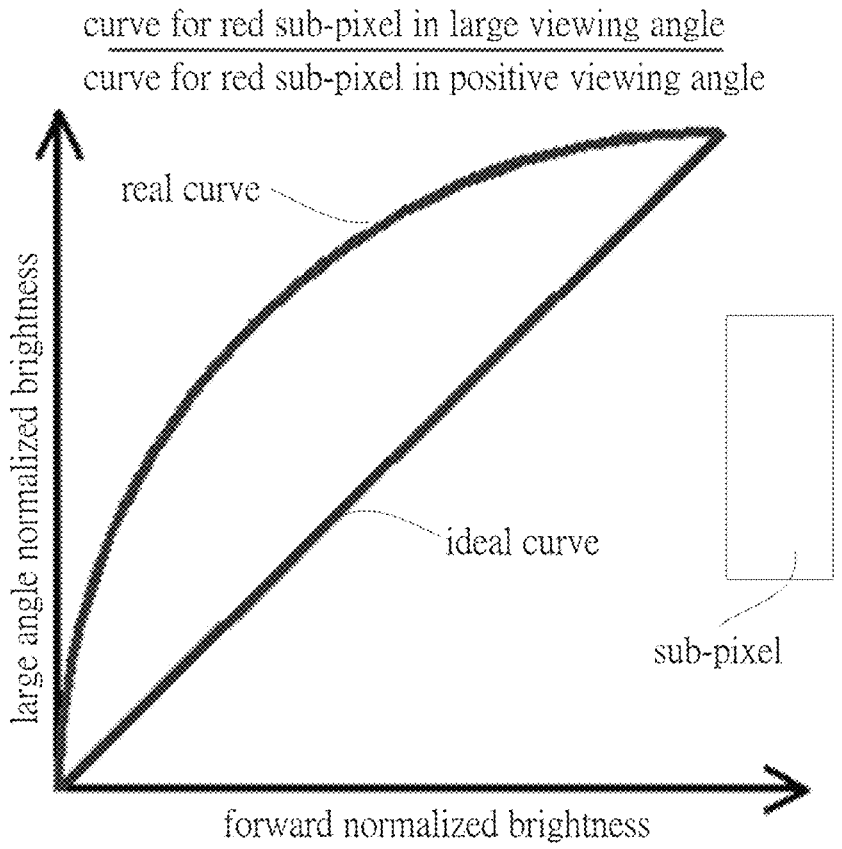
FIG. 1 is a graph showing a conventional pixel at a front-view angle and a large angle.

In order to make this disclosure be understood, more comprehensive descriptions of this disclosure will be made in the following with reference to the associated drawings. Preferred embodiments of this disclosure are given in the drawings. However, this disclosure may be implemented in various forms, and is not restricted to the embodiments disclosed herein. On the contrary, the purpose of providing these embodiments is to make the contents of this disclosure be understood more comprehensively.

Unless otherwise defined, all technical and scientific terms used herein have the same meaning as commonly understood by those skilled in the art to which the invention pertains. The terminology used herein in the specification of the invention is for the purpose of describing particular embodiments only and is not intended to limit the present disclosure. The term "and/or" as used herein includes any and all combinations of one or more of the associated listed items.

As shown in FIG. 1, the VA liquid crystal drive at the large viewing angle brightness rapidly saturates with the voltage, as shown in the curve L20 of FIG. 1, thereby causing the viewing-angle quality contrast and the color shift to be seriously deteriorated as compared with the front-viewing quality, wherein the curve showing the relationship between the front view brightness and the voltage is shown by the curve L10 of FIG. 1.

Figure 2:
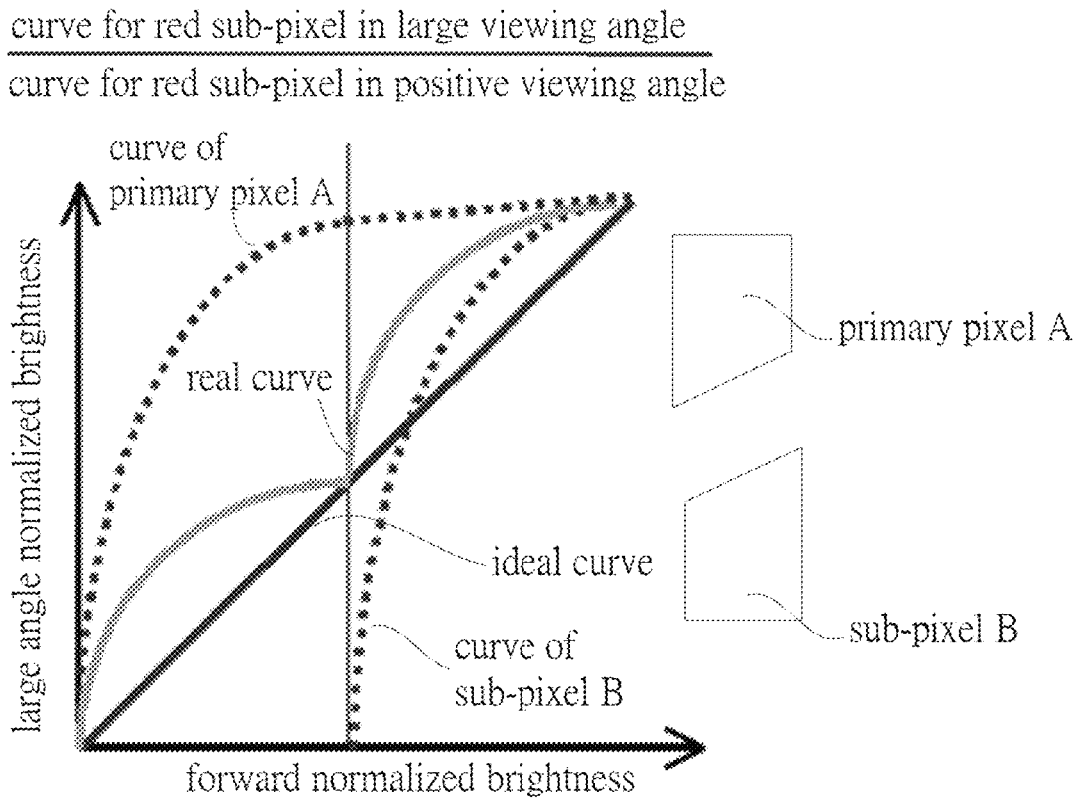
FIG. 2 is a graph showing a conventional primary pixel and a conventional secondary pixel at a front-view angle and a large angle.
Figure 3:
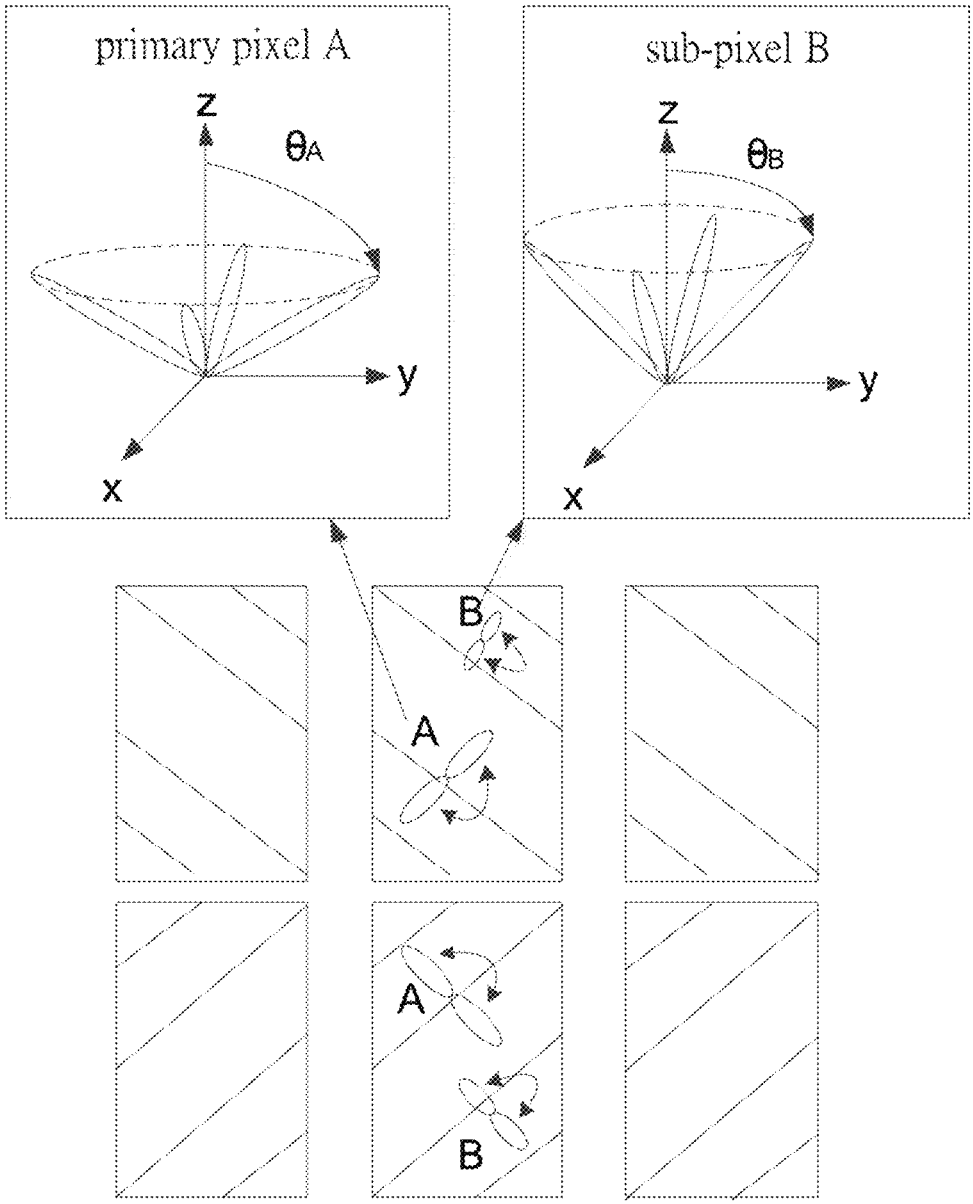
FIG. 3 is a schematic motion diagram showing conventional liquid crystal molecules.

In the VA liquid crystal technology, in order to solve the viewing-angle color shift, each sub-pixel of RGB is divided into a primary pixel and a secondary pixel, and then different drive voltages are provided to the primary pixel and the secondary pixel in the space domain. FIG. 2 is a graph showing that the sub-pixel is divided into the primary pixel and the secondary pixel, and it is obtained that dividing the sub-pixel into the primary pixel and the secondary pixel can effectively solve the defect of the viewing-angle color shift, so that the overall large viewing-angle brightness changes with the voltage in a manner closer to that of the front view, and the L21 curve showing the relationship between the large viewing angle brightness and the voltage is shown in FIG. 2 and is closer to the curved surface L11 showing the relationship between the brightness and the voltage, as shown in the FIG. 2, wherein L22 and L23 are graphs showing the primary pixel and the secondary pixel, respectively. FIG. 3 is a schematic motion diagram of pixel molecules showing the RGB sub-pixel liquid crystal molecules in the low gray scale, the middle gray scale and the high gray scale, respectively, wherein the motions of the primary pixel A and the secondary pixel B of the liquid crystal molecules of the green sub-pixel G in the middle gray scale are shown in FIG. 3. However, such the pixel design needs a metal layout or a TFT element to drive the secondary pixel, thereby sacrificing the transmission opening area, affecting the panel permeability, and directly increasing the backlight cost.

Figure 4:
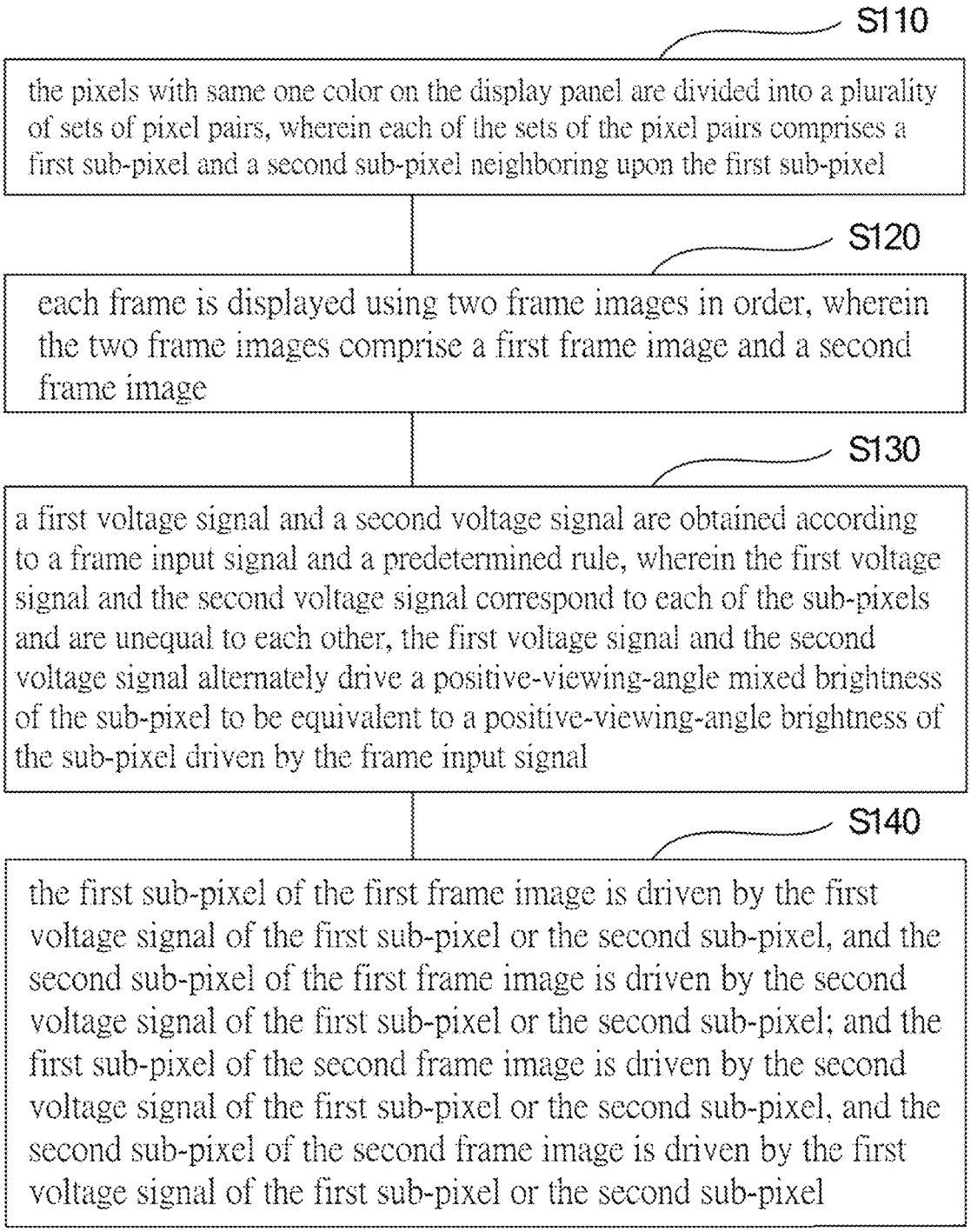
FIG. 4 is a flow chart showing a driving method of a display panel in one embodiment.
Figure 5:
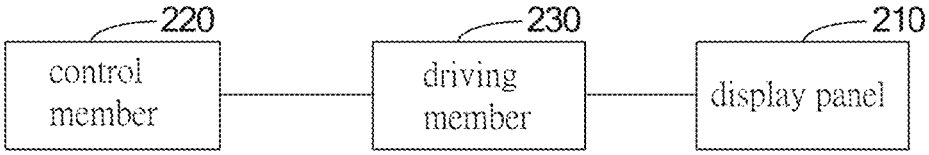
FIG. 5 is a block diagram showing a display device in one embodiment.

Referring to FIG. 4, in one embodiment, a driving method of a display panel comprises the following steps.

In step S110, the pixels with same one color on the display panel are divided into a plurality of sets of pixel pairs, wherein each of the sets of the pixel pairs comprises a first sub-pixel and a second sub-pixel neighboring upon the first sub-pixel.

In step S120, each frame is displayed using two frame images in order, wherein the two frame images comprise a first frame image and a second frame image.

In step S130, a first voltage signal and a second voltage signal, which correspond to each of the sub-pixels and are unequal to each other, are obtained according to a frame input signal and a predetermined rule, wherein the first voltage signal and the second voltage signal alternately drive a positive-viewing-angle mixed brightness of the sub-pixel to be equivalent to a positive-viewing-angle brightness of the sub-pixel driven by the frame input signal.

In step S140, the first sub-pixel of the first frame image is driven by the first voltage signal of the first sub-pixel or the second sub-pixel, and the second sub-pixel of the first frame image is driven by the second voltage signal of the first sub-pixel or the second sub-pixel; and the first sub-pixel of the second frame image is driven by the second voltage signal of the first sub-pixel or the second sub-pixel, and the second sub-pixel of the second frame image is driven by the first voltage signal of the first sub-pixel or the second sub-pixel.

The above-mentioned driving method comprises respectively driving the first sub-pixel and the second sub-pixel of the first frame image by a high voltage signal and a low voltage signal, and driving the first sub-pixel and the second sub-pixel of the second frame image by a corresponding low voltage signal and a corresponding high voltage signal. The color difference drawback caused by the mismatch of the refractive index of the display panel at the large viewing angle can be improved, and this disclosure is particularly applicable to the TN, the OCB, and the VA type liquid crystal display panels, so that the processes of this method are simple, and the production yield is high.

In step S120, each frame is displayed using two frame images in order, wherein the two frame images comprise a first frame image and a second frame image. An input frame as shown in Table 1 is sequentially displayed using the first frame image shown in Table 2 and the second frame image shown in Table 3. Specifically, the red sub-pixel will be described by taking the display panel with the three primary colors of RGB as an example, wherein the original corresponding frame sub-pixel signal $R_{i,j}$ is decomposed into a high voltage $RH_{i,j}$ frame and a low voltage $RL_{i,j}$ frame in the space, and the high voltage frame and the low voltage frame are sequentially displayed at neighboring timings. The synthesis effect of the high voltage frame and the low voltage frame is equivalent to the brightness of each sub-pixel of the original frame. The high voltage frame signal and the low voltage frame signal replace the original frame signal to achieve keeping the front view brightness unchanged at the brightness of the original image signal. At the angle of side view, the high voltage frame and the low voltage frame are displayed at neighboring two timings. Compared with the brightness saturation phenomenon of the original frame, the property of the viewing angle of the low voltage frame can be improved so that the color difference of the viewing angle can be improved. The methods the same as that of the red sub-pixel may be used in the green sub-pixel and the blue sub-pixel. However, such the drive needs the switching between the high voltage frame and the low voltage frame, and the human eye can easily observe flicker defect. The scan frequency of the frame can be increased to reduce the observed flicker defect. However, under the restriction of the technology bottleneck of the liquid crystal panel charging, increasing the scan frequency of the frame can reduce the transmittance of the panel or sacrifice the production yield, and decrease the competitiveness of products.

TABLE 1

| | | | | | | | | |
|---|---|---|---|---|---|---|---|---|
| R1, 1 | R1, 2 | R1, 3 | R1, 4 | R1, 5 | R1, 6 | . . . . . | R1, j − 1 | R1, j |
| R2, 1 | R2, 2 | R2, 3 | R2, 4 | R2, 5 | R2, 6 | . . . . . | R2, j − 1 | R2, j |
| R3, 1 | R3, 2 | R3, 3 | R3, 4 | R3, 5 | R3, 6 | . . . . . | R3, j − 1 | R3, j |
| R4, 1 | R4, 2 | R4, 3 | R4, 4 | R4, 5 | R4, 6 | . . . . . | R4, j − 1 | R4, j |
| R5, 1 | R5, 2 | R5, 3 | R5, 4 | R5, 5 | R5, 6 | . . . . . | R5, j − 1 | R5, j |
| R6, 1 | R6, 2 | R6, 3 | R6, 4 | R6, 5 | R6, 6 | . . . . . | R6, j − 1 | R6, j |
| . . . | . . . | . . . | . . . | . . . | . . . | . . . . . | . . . | . . . |
| . . . | . . . | . . . | . . . | . . . | . . . | . . . . . | . . . | . . . |
| Ri − 1, 1 | Ri − 1, 2 | Ri − 1, 3 | Ri − 1, 4 | Ri − 1, 5 | Ri − 1, 6 | . . . . . | Ri − 1, j − 1 | Ri − 1, j |
| Ri, 1 | Ri, 2 | Ri, 3 | Ri, 4 | Ri, 5 | Ri, 6 | . . . . . | Ri, j − 1 | Ri, i |

TABLE 2

| | | | | | | | | |
|---|---|---|---|---|---|---|---|---|
| RH1, 1 | RH1, 2 | RH1, 3 | RH1, 4 | RH1, 5 | RH1, 6 | . . . . . | RH1, j − 1 | RH1, j |
| RH2, 1 | RH2, 2 | RH2, 3 | RH2, 4 | RH2, 5 | RH2, 6 | . . . . . | RH2, j − 1 | RH2, j |
| RH3, 1 | RH3, 2 | RH3, 3 | RH3, 4 | RH3, 5 | RH3, 6 | . . . . . | RH3, j − 1 | RH3, j |
| RH4, 1 | RH4, 2 | RH4, 3 | RH4, 4 | RH4, 5 | RH4, 6 | . . . . . | RH4, j − 1 | RH4, j |
| RH5, 1 | RH5, 2 | RH5, 3 | RH5, 4 | RH5, 5 | RH5, 6 | . . . . . | RH5, j − 1 | RH5, j |
| RH6, 1 | RH6, 2 | RH6, 3 | RH6, 4 | RH6, 5 | RH6, 6 | . . . . . | RH6, j − 1 | RH6, j |
| . . . | . . . | . . . | . . . | . . . | . . . | . . . . . | . . . | . . . |
| . . . | . . . | . . . | . . . | . . . | . . . | . . . . . | . . . | . . . |
| RHi − 1, 1 | RHi − 1, 2 | RHi 1, 3 | RHi − 1, 4 | RHi − 1, 5 | RHi − 1, 6 | . . . . . | RHi − 1, j − 1 | RH9, j |
| RHi, 1 | RHi, 2 | RHi, 3 | RHi, 4 | RHi, 5 | RHi, 6 | . . . . . | RHi, j − 1 | RHi, i |

TABLE 3

| | | | | | | | | |
|---|---|---|---|---|---|---|---|---|
| RL1, 1 | RL1, 2 | RL1, 3 | RL1, 4 | RL1, 5 | RL1, 6 | . . . . . | RL1, j − 1 | RL1, j |
| RL2, 1 | RL2, 2 | RL2, 3 | RL2, 4 | RL2, 5 | RL2, 6 | . . . . . | RL2, j − 1 | RL2, j |
| RL3, 1 | RL3, 2 | RL3, 3 | RL3, 4 | RL3, 5 | RL3, 6 | . . . . . | RL3, j − 1 | RL3, j |
| RL4, 1 | RL4, 2 | RL4, 3 | RL4, 4 | RL4, 5 | RL4, 6 | . . . . . | RL4, j − 1 | RL4, j |
| RL5, 1 | RL5, 2 | RL5, 3 | RL5, 4 | RL5, 5 | RL5, 6 | . . . . . | RL5, j − 1 | RL5, j |
| RL6, 1 | RL6, 2 | RL6, 3 | RL6, 4 | RL6, 5 | RL6, 6 | . . . . . | RL6, j − 1 | RL6, j |
| . . . | . . . | . . . | . . . | . . . | . . . | . . . . . | . . . | . . . |
| . . . | . . . | . . . | . . . | . . . | . . . | . . . . . | . . . | . . . |
| RLi − 1, 1 | RLi − 1, 2 | RLi 1, 3 | RLi − 1, 4 | RLi − 1, 5 | RLi − 1, 6 | . . . . . | RLi − 1, j − 1 | RLi − 1, j |
| RLi, 1 | RLi, 2 | RLi, 3 | RLi, 4 | RLi, 5 | RLi, 6 | . . . . . | RLi, j − 1 | RLi, j |

The high and low voltage signals of the red sub-pixel R, the green sub-pixel G and the blue sub-pixel B are the high and low voltage signals which have been given in advance according to the RGB input signal, are determined according to the viewing angle effect that needs to be compensated, and are generally recorded inside the display panel in the form of a look-up table LUT. Further, the lookup table LUT is recorded inside the hardware frame buffer of the display panel. Looking at a 8 bit drive signal, the input signal of each of the red sub-pixel R, the green sub-pixel G and the blue sub-pixel B has the inputs from 0 to 255, there are 256 high and low voltage signals in total, and there are 3*256 pairs of high voltage signals RH, GH and BH and low voltage signals RL, GL and BL in total. For example, the lookup table of the blue sub-pixel is listed in Table 4.

TABLE 4

| | LUT1 | | LUT2 | |
|---|---|---|---|---|
| Input gray scale value | BH1 | BL1 | BH2 | BL2 |
| 0 | 0 | 0 | 0 | 0 |
| 1 | 50 | 0 | 40 | 0 |
| 2 | 80 | 5 | 70 | 10 |
| 3 | 100 | 10 | 100 | 35 |
| 4 | 150 | 20 | 180 | 45 |
| 5 | 180 | 40 | 200 | 65 |
| . | . | . | . | . |
| . | . | . | . | . |
| . | . | . | . | . |
| 255 | 255 | 128 | 255 | 160 |

Optionally, the first voltage signal and the second voltage signal corresponding to each of the sub-pixels are obtained according to a frame-input-signal look-up-table. The positive-viewing-angle mixed brightness of the first voltage signal and the second voltage signal is equivalent to the positive-viewing-angle brightness of the frame input signal. Different lookup tables can be selected according to different circumstances, such as the average of the original input gray scale values of one set of pixel pair, the average of the original input gray scale values of a plurality of sets of pixel pairs with same one color, the average of the original input gray scale values of a plurality of sets of pixel pairs with different colors, or the like. The number of lookup tables may be adjusted to be 2, 5, 10 or the like according to the requirements.

In another embodiment, a conversion relationship is obtained according to the input signal of the sub-pixel; and the original drive data of each of the sub-pixels correspond to one set of target gray scale value pairs according to the conversion relationship. If the input value of the sub-pixel is smaller than the first predetermined value, such as 0.2V, then a first coefficient greater than 1 is multiplied to obtain the first voltage signal, a second coefficient smaller than 1 is multiplied to obtain the second voltage signal, wherein different first coefficients and second coefficients are obtained according to different input values of the sub-pixels, so that a set of different target gray scale value pairs are obtained.

For example, the first voltage signal is greater than the second voltage signal.

Optionally, the first sub-pixel and the second sub-pixel can be disposed on the same row and neighbor upon each other (i.e., transversally neighbor upon each other), the first sub-pixel of the first frame image is driven by the first voltage signal of the first sub-pixel, and the second sub-pixel of the first frame image is driven by the second voltage signal of the first sub-pixel, as shown in Table 5. The first sub-pixel of the second frame image is driven by the second voltage signal of the second sub-pixel, and the second sub-pixel of the second frame image is driven by the first voltage signal of the second sub-pixel, as shown in Table 6. Further in this embodiment, the first sub-pixels in one of the sets of the pixel pairs of the neighboring two sets of pixel pairs in the same column neighbor upon the second sub-pixels in the other of the sets of pixel pairs, that is, the first sub-pixels in one of the sets of the pixel pairs of the longitudinally neighboring two sets of pixel pairs are disposed on the right side of the second sub-pixel, and the first sub-pixels in the other set of pixel pair are disposed on the left side of the second sub-pixels. The first blue sub-pixels for implementing the neighboring pixel pairs are staggered.

TABLE 5

| | | | | | | | | |
|---|---|---|---|---|---|---|---|---|
| RH1, 1 | RL1, 1 | RH1, 3 | RL1, 3 | RH1, 5 | RL1, 5 | . . . . . | RH1, j − 1 | RL1, j − 1 |
| RL2, 2 | RH2, 2 | RL2, 4 | RH2, 4 | RL2, 6 | RH2, 6 | . . . . . | RL2, j | RH2, j |
| RH3, 1 | RL3, 1 | RH3, 3 | RL3, 3 | RH3, 5 | RL3, 5 | . . . . . | RH3, j − 1 | RL3, j − 1 |
| RL4, 2 | RH4, 2 | RL4, 4 | RH4, 4 | RL4, 6 | RH4, 6 | . . . . . | RL4, j | RH4, j |
| RH5, 1 | RL5, 1 | RH5, 3 | RL5, 3 | RH5, 5 | RL5, 5 | . . . . . | RH5, j − 1 | RL5, j − 1 |
| RL6, 2 | RH6, 2 | RL6, 4 | RH6, 4 | RL6, 6 | RH6, 6 | . . . . . | RL6, j | RH6, j |
| . . . | . . . | . . . | . . . | . . . | . . . | . . . . . | | . . . |
| . . . | . . . | . . . | . . . | . . . | . . . | . . . . . | | . . . |
| RHi − 1, 2 | RLi − 1, 2 | RHi − 1, 4 | RLi − 1, 4 | RHi − 1, 6 | RLi − 1, 6 | . . . . . | RHi − 1, j | RLi − 1, j |
| RLi, 1 | RHi, 1 | RLi, 3 | RHi, 3 | RLi, 5 | RHi,5 | . . . . . | RLi, j − 1 | RHi, j − 1 |

TABLE 6

| | | | | | | | | |
|---|---|---|---|---|---|---|---|---|
| RL1, 2 | RH1, 2 | RL1, 4 | RH1, 4 | RL1, 6 | RH1, 6 | . . . . . | RL1, j | RH1, j |
| RH2, 1 | RL2, 1 | RH2, 3 | RL2, 3 | RH2, 5 | RL2, 5 | . . . . . | RH2, j − 1 | RL2, j − 1 |
| RL3, 2 | RH3, 2 | RL3, 4 | RH3, 4 | RL3, 6 | RH3, 6 | . . . . . | RL3, j | RH3, j |
| RH4, 1 | RL4, 1 | RH4, 3 | RL4, 3 | RH4, 5 | RL4, 5 | . . . . . | RH4, j − 1 | RL4, j − 1 |
| RL5, 2 | RH5, 2 | RL5, 4 | RH5, 4 | RL5, 6 | RH5, 6 | . . . . . | RL5, j | RH5, j |
| RH6, 1 | RL6, 1 | RH6, 3 | RL6, 3 | RH6, 5 | RL6, 5 | . . . . . | RH6, j − 1 | RL6, j − 1 |
| . . . | . . . | . . . | . . . | . . . | . . . | . . . . . | . . . | . . . |
| . . . | . . . | . . . | . . . | . . . | . . . | . . . . . | . . . | . . . |
| RLi − 1, 1 | RHi − 1, 1 | RLi − 1, 3 | RHi − 1, 3 | RLi − 1, 5 | RHi − 1, 5 | . . . . . | RLi − 1, j − 1 | RHi − 1, j − 1 |
| RHi, 2 | RLi, 2 | RHi, 4 | RLi, 4 | RHi, 6 | RLi, 6 | . . . . . | RHi, j | RLi, j |

Optionally, the first sub-pixel and the second sub-pixel also can be disposed in the same column and neighbor upon each other (i.e., longitudinally neighbor upon each other), as shown in Tables 7 and 8. Further in this embodiment, the first sub-pixels in one of the sets of the pixel pairs of the neighboring two sets of pixel pairs in the same row neighbor upon the second sub-pixels in the other of the sets of pixel pairs, that is, the first sub-pixels in one of the sets of the pixel pairs of the transversally neighboring two sets of pixel pairs are disposed above the second sub-pixel, and the first sub-pixels in the other set of pixel pair are disposed under the second sub-pixels. The first blue sub-pixels for implementing the neighboring pixel pairs are staggered.

TABLE 7

| | | | | | | | | |
|---|---|---|---|---|---|---|---|---|
| RH1, 1 | RL2, 2 | RH1, 3 | RL2, 4 | RH1, 5 | RL2, 6 | . . . . . | RH1, j − 1 | RL2, j |
| RL1, 1 | RH2, 2 | RL1, 3 | RH2, 4 | RL1, 5 | RH2, 6 | . . . . . | RL1, j − 1 | RH2, j |
| RH3, 1 | RL4, 2 | RH3, 3 | RL4, 4 | RH3, 5 | RL4, 6 | . . . . . | RH3, j − 1 | RL4, j |
| RL3, 1 | RH4, 2 | RL3, 3 | RH4, 4 | RL3, 5 | RH4, 6 | . . . . . | RL3, j − 1 | RH4, j |
| RH5, 1 | RL6, 2 | RH5, 3 | RL6, 4 | RH5, 5 | RL6, 6 | . . . . . | RH5, j − 1 | RL6, j |
| RL5, 1 | RH6, 2 | RL5, 3 | RH6, 4 | RL5, 5 | RH6, 6 | . . . . . | RL5, j − 1 | RH6, j |
| . . . | . . . | . . . | . . . | . . . | . . . | . . . . . | . . . | . . . |
| . . . | . . . | . . . | . . . | . . . | . . . | . . . . . | . . . | . . . |
| RHi − 1, 1 | RLi, 2 | RHi − 1, 3 | RLi, 4 | RHi − 1, 5 | RLi, 6 | . . . . . | RHi 1, j − 1 | RLi, j |
| RLi − 1, 1 | RHi, 2 | RLi − 1, 3 | RHi, 4 | RLi − 1, 5 | RHi, 6 | . . . . . | RLi − 1, j − 1 | RHi, j |

TABLE 8

| | | | | | | | | |
|---|---|---|---|---|---|---|---|---|
| RL2, 1 | RH1, 2 | RL2, 3 | RH1, 4 | RL2, 5 | RH1, 6 | . . . . . | RL2, j − 1 | RH1, j |
| RH2, 1 | RL1, 2 | RH2, 3 | RL1, 4 | RH2, 5 | RL1, 6 | . . . . . | RH2, j − 1 | RL1, j |
| RL4, 1 | RH3, 2 | RL4, 3 | RH3, 4 | RL4, 5 | RH3, 6 | . . . . . | RL4, j − 1 | RH3, j |
| RH4, 1 | RL3, 2 | RH4, 3 | RL3, 4 | RH4, 5 | RL3, 6 | . . . . . | RH4, j − 1 | RL3, j |
| RL6, 1 | RH5, 2 | RL6, 3 | RH5, 4 | RL6, 5 | RH5, 6 | . . . . . | RL6, j − 1 | RH5, j |
| RH6, 1 | RL5, 2 | RH6, 3 | RL5, 4 | RH6, 5 | RL5, 6 | . . . . . | RH6, j − 1 | RL5, j |
| . . . | . . . | . . . | . . . | . . . | . . . | . . . . . | . . . | . . . |
| . . . | . . . | . . . | . . . | . . . | . . . | . . . . . | . . . | . . . |
| RLi, 1 | RHi − 1, 2 | RLi, 3 | RHi − 1, 4 | RLi, 5 | RHi − 1, 6 | . . . . . | RLi, j − 1 | RHi − 1, j |
| RHi, 1 | RLi − 1, 2 | RHi, 3 | RLi − 1, 4 | RHi, 5 | RLi − 1, 6 | . . . . . | RHi, j − 1 | RLi − 1, j |

Further optionally, the first sub-pixel and the second sub-pixel can transversally neighbor upon each other, the first sub-pixel of the first frame image is driven by the first voltage signal of the first sub-pixel, and the second sub-pixel of the first frame image is driven by the second voltage signal of the second sub-pixel, as shown in Table 9; and the first sub-pixel of the second frame image is driven by the second voltage signal of the first sub-pixel, and the second sub-pixel of the second frame image is driven by the first voltage signal of the second sub-pixel, as shown in Table 10. The first sub-pixel and the second sub-pixel may also longitudinally neighbor upon each other.

TABLE 9

| | | | | | | | | |
|---|---|---|---|---|---|---|---|---|
| RH1, 1 | RL1, 2 | RH1, 3 | RL1, 4 | RH1, 5 | RL1, 6 | . . . . . | RH1, j − 1 | RL1, j |
| RL2, 1 | RH2, 2 | RL2, 3 | RH2, 4 | RL2, 5 | RH2, 6 | . . . . . | RL2, j − 1 | RH2, j |
| RH3, 1 | RL3, 2 | RH3, 3 | RL3, 4 | RH3, 5 | RL3, 6 | . . . . . | RH3, j − 1 | RL3, j |
| RL4, 1 | RH4, 2 | RL4, 3 | RH4, 4 | RL4, 5 | RH4, 6 | . . . . . | RL4, j − 1 | RH4, j |
| RH5, 1 | RL5, 2 | RH5, 3 | RL5, 4 | RH5, 5 | RL5, 6 | . . . . . | RH5, j − 1 | RL5, j |
| RL6, 1 | RH6, 2 | RL6, 3 | RH6, 4 | RL6, 5 | RH6, 6 | . . . . . | RL6, j − 1 | RH6, j |
| . . . | . . . | . . . | . . . | . . . | . . . | . . . . . | . . . | . . . |
| . . . | . . . | . . . | . . . | . . . | . . . | . . . . . | . . . | . . . |
| RHi − 1, 1 | RLi − 1, 2 | RHi − 1, 3 | RLi − 1, 4 | RHi − 1, 5 | RLi − 1, 6 | . . . . . | RHi − 1, j − 1 | RLi − 1, j |
| RLi, 1 | RHi, 2 | RLi, 3 | RHi, 4 | RLi, 5 | RHi, 6 | . . . . . | RLi, j − 1 | RHi, j |

TABLE 10

| | | | | | | | | |
|---|---|---|---|---|---|---|---|---|
| RL1, 1 | RH1, 2 | RL1, 3 | RH1, 4 | RL1, 5 | RH1, 6 | . . . . . | RL1, j − 1 | RH1, j |
| RH2, 1 | RL2, 2 | RH2, 3 | RL2, 4 | RH2, 5 | RL2, 6 | . . . . . | RH2, j − 1 | RL2, j |
| RL3, 1 | RH3, 2 | RL3, 3 | RH3, 4 | RL3, 5 | RH3, 6 | . . . . . | RL3, j − 1 | RH3, j |
| RH4, 1 | RL4, 2 | RH4, 3 | RL4, 4 | RH4, 5 | RL4, 6 | . . . . . | RH4, j − 1 | RL4, j |
| RL5, 1 | RH5, 2 | RL5, 3 | RH5, 4 | RL5, 5 | RH5, 6 | . . . . . | RL5, j − 1 | RH5, j |

TABLE 10-continued

| | | | | | | | | |
|---|---|---|---|---|---|---|---|---|
| RH6, 1 | RL6, 2 | RH6, 3 | RL6, 4 | RH6, 5 | RL6, 6 | . . . . . | RH6, j − 1 | RL6, j |
| . . . | . . . | . . . | . . . | . . . | . . . | . . . . . | . . . | . . . |
| . . . | . . . | . . . | . . . | . . . | . . . | . . . . . | . . . | . . . |
| RLi − 1, 1 | RHi − 1, 2 | RLi − 1, 3 | RHi − 1, 4 | RLi − 1, 5 | RHi − 1, 6 | . . . . . | RLi − 1, j − 1 | RHi − 1, j |
| RHi, 1 | RLi, 2 | RHi, 3 | RLi, 4 | RHi, 5 | RLi, 6 | . . . . . | RHi, j − 1 | RLi, j |

Further optionally, the first sub-pixel of the first frame image is driven by the first voltage signal of the second sub-pixel, and the second sub-pixel of the first frame image is driven by the second voltage signal of the second sub-pixel; and the first sub-pixel of the second frame image is driven by the second voltage signal of the first sub-pixel, and the second sub-pixel of the second frame image is driven by the first voltage signal of the first sub-pixel. The first sub-pixel and the second sub-pixel may transversally neighbor upon each other, the first sub-pixel and the second sub-pixel may also longitudinally neighbor upon each other.

Optionally, in the above-mentioned embodiment, the condition that the first voltage signal is greater than the second voltage signal may be replaced with the condition that the first voltage signal is smaller than the second voltage signal.

In the above-mentioned embodiment, the first sub-pixel and the second sub-pixel transversally neighbor upon each other. In detail, the first sub-pixels in one of the sets of the pixel pairs of the longitudinally neighboring two sets of pixel pairs are disposed on the right side of the second sub-pixel, and the first sub-pixels in the other set of pixel pair are disposed on the left side of the second sub-pixels.

In the above-mentioned embodiment, the first sub-pixel and the second sub-pixel longitudinally neighbor upon each other. In detail, the first sub-pixels in one of the sets of the pixel pairs of the transversally neighboring two sets of pixel pairs are disposed above the second sub-pixel, and the first sub-pixels in the other set of pixel pair are disposed under the second sub-pixels.

Adopting the above-mentioned embodiment can solve the flicker defect problem caused by the switching when the single frame simply has the high voltage, and the other frame simply has the low voltage, the original frame is divided into two continuous frames for output, and the sub-pixel arrangement in each output frame has the sub-pixel arrangement where the high and low voltages alternate. The positions of the same sub-pixel in continuous frames are sequentially the high and low voltage outputs or the low and high voltage outputs. The high and low voltage arrangements are present in different positions of the same frame, so that the brightness difference between the continuous frame output is decreased, and the switching flicker defect occurred when two frames are the same and are the high voltage frame and the low voltage frame can be reduced.

In addition, because the sub-pixel signal of the original frame must be replaced with the high voltage sub-pixel and the low voltage sub-pixel to improve the color shift, displaying the high voltage and low voltage sub-pixel information in the same frame inevitably sacrifices the original frame information resolution. Using the high voltage and low voltage sub-pixel arrangement and timing driving method in the above-mentioned embodiment can keep the original image resolution from being affected upon being observed by the human eye.

Optionally, the first sub-pixel and the second sub-pixel of each set of pixel pairs can transversally neighbor upon each other, as shown in Tables 5 and 6, and can also longitudinally neighbor upon each other, as shown in Tables 7 and 8.

Optionally, the display panel comprises red pixels, green pixels and blue pixels. The red pixels on the display panel are divided into a plurality of sets of red pixel pairs, the green pixels are divided into a plurality of sets of green pixel pairs, and the blue pixels are divided into a plurality of sets of blue pixel pairs.

Further, the display panel comprises red pixels, green pixels, blue pixels and yellow pixels. The red pixels on the display panel are divided into a plurality of sets of red pixel pairs, the green pixels are divided into a plurality of sets of green pixel pairs, the blue pixels are divided into a plurality of sets of blue pixel pairs, and the yellow pixels are divided into a plurality of sets of yellow pixel pairs.

The driving method of the display panel can improve the drawback of the color shift or the color difference caused by the mismatch of the refractive index of the display panel at the large viewing angle.

The display panel may be a twisted nematic (TN), optically compensated birefringence (OCB), and vertical alignment (VA) type liquid crystal display panel, but is not limited thereto. The display panel may be a three primary color (RGB) panel, a four-color (RGBW) panel or a four-color (RGBY) panel, but is not limited thereto. The display panel may also be an OLED display panel, a QLED display panel, a curved surface display panel or other display panels. The driving method is also applicable to the condition when the display panel is the curved surface panel.

Referring to FIG. 4, a display device comprises a display panel 210, a control member 220 and a driving member 230.

The pixels with same one color on the display panel 210 are divided into a plurality of sets of pixel pairs, and each of the sets of the pixel pairs comprises a first sub-pixel and a second sub-pixel.

The control member 220 is for displaying each frame using two frame images in order, wherein the two frame images comprise a first frame image and a second frame image. The control member 220 is further for obtaining a first voltage signal and a second voltage signal, which correspond to each of the sub-pixels and are unequal to each other, according to a frame input signal and a predetermined rule, wherein the first voltage signal and the second voltage signal alternately drive a positive-viewing-angle mixed brightness of the sub-pixel to be equivalent to a positive-viewing-angle brightness of the sub-pixel driven by the frame input signal.

The driving member 230 connected to the control member 220 and the display panel 210 is for driving the first sub-pixel of the first frame image by the first voltage signal of the first sub-pixel or the second sub-pixel, and driving the second sub-pixel of the first frame image by the second voltage signal of the first sub-pixel or the second sub-pixel; and further for driving the first sub-pixel of the second frame image by the second voltage signal of the first sub-pixel or the second sub-pixel, and driving the second sub-pixel of the second frame image by the first voltage signal of the first sub-pixel or the second sub-pixel.

Optionally, the first sub-pixel and the second sub-pixel on the display panel 210 may be disposed in the same row and neighbor upon each other (i.e., transversally neighbor upon each other). Further, the first sub-pixels in one of the sets of the pixel pairs of the neighboring two sets of pixel pairs in the same column neighbor upon the second sub-pixels in the other of the sets of pixel pairs, that is, the first sub-pixels in one of the sets of the pixel pairs of the longitudinally neighboring two sets of pixel pairs are disposed on the right side of the second sub-pixel, and the first sub-pixels in the other set of pixel pair are disposed on the left side of the second sub-pixels. The first blue sub-pixels for implementing the neighboring pixel pairs are staggered.

Optionally, the first sub-pixel and the second sub-pixel on the display panel 210 may be disposed in the same row and neighbor upon each other (longitudinally neighbor upon each other). Further, the first sub-pixels in one of the sets of the pixel pairs of the neighboring two sets of pixel pairs in the same column neighbor upon the second sub-pixels in the other of the sets of pixel pairs, that is, the first sub-pixels in one of the sets of the pixel pairs of the transversally neighboring two sets of pixel pairs are disposed above the second sub-pixel, and the first sub-pixels in the other set of pixel pair are disposed under the second sub-pixels. The first blue sub-pixels for implementing the neighboring pixel pairs are staggered.

Optionally, the control member 220 further comprises a looking unit. The looking unit obtains a first voltage signal and a second voltage signal, which correspond to each of the sub-pixels and are unequal to each other, according to a frame-input-signal look-up-table. The first voltage signal and the second voltage signal alternately drive a positive-viewing-angle mixed brightness of the sub-pixel to be equivalent to a positive-viewing-angle brightness of the sub-pixel driven by the frame input signal.

Optionally, the display panel 210 comprises red pixels, green pixels and blue pixels. The red pixels on the display panel 210 comprise a plurality of sets of red pixel pairs, the green pixels comprise a plurality of sets of green pixel pairs, and the blue pixels comprise a plurality of sets of blue pixel pairs.

Further, the display panel 210 comprises red pixels, green pixels, blue pixels and yellow pixels. The red pixels on display panel 210 comprise a plurality of sets of red pixel pairs, the green pixels comprise a plurality of sets of green pixel pairs, the blue pixels comprise a plurality of sets of blue pixel pairs, and the yellow pixels comprise a plurality of sets of yellow pixel pairs.

The display device can improve the drawback of the color shift or the color difference caused by the mismatch of the refractive index of the display panel at the large viewing angle. The display panel can be a TN, an OCB, and a VA type liquid crystal display panel, but is not limited thereto. The display panel can be a three primary color (RGB) panel, a four-color (RGBW) panel or a four-color (RGBY) panel, but is not limited thereto. The driving method is also applicable to the condition when the display panel is the curved surface panel.

The technical features of the above-described embodiments may be arbitrarily combined. In order to make the description concise, not all of the possible combinations of the various technical features in the above-described embodiments are described. However, as long as there is no contradiction in the combination of these technical features, it should be considered as the scope of this specification.

The embodiments described above are merely illustrative of several embodiments of the present disclosure and are more specific and detailed, but are not to be construed as limiting the scope of the invention. It should be noted that it will be apparent to those skilled in the art that various changes and modifications may be made therein without departing from the spirit of this disclosure, and these are within the scope of this disclosure. Accordingly, the scope of the present patent application is subject to the appended claims.

What is claimed is:

1. A driving method of a display panel, comprising:

dividing pixels with same one color on the display panel into a plurality of sets of pixel pairs, wherein each of the sets of the pixel pairs comprises a first sub-pixel and a second sub-pixel neighboring upon the first sub-pixel;

displaying each frame using two frame images in order, wherein the two frame images comprise a first frame image and a second frame image;

obtaining a first voltage signal and a second voltage signal according to a frame input signal and a predetermined rule, wherein the first voltage signal and the second voltage signal correspond to each of the sub-pixels and are unequal to each other, the first voltage signal and the second voltage signal alternately drive a positive-viewing-angle mixed brightness of the sub-pixel to be equivalent to a positive-viewing-angle brightness of the sub-pixel driven by the frame input signal; and driving the first sub-pixel of the first frame image by the first voltage signal of the first sub-pixel or the second sub-pixel, and driving the second sub-pixel of the first frame image by the second voltage signal of the first sub-pixel or the second sub-pixel; and driving the first sub-pixel of the second frame image by the second voltage signal of the first sub-pixel or the second sub-pixel, and driving the second sub-pixel of the second frame image by the first voltage signal of the first sub-pixel or the second sub-pixel.

2. The method according to claim 1, wherein the first sub-pixel and the second sub-pixel are disposed on the same row and neighbor upon each other.

3. The method according to claim 2, wherein the first sub-pixels in one of the sets of the pixel pairs of the neighboring two sets of pixel pairs in the same column neighbor upon the second sub-pixels in the other of the sets of pixel pairs.

4. The method according to claim 1, wherein the first sub-pixel and the second sub-pixel are disposed in the same column and neighbor upon each other.

5. The method according to claim 4, wherein the first sub-pixels in one of the sets of the pixel pairs of the neighboring two sets of pixel pairs in the same row neighbor upon the second sub-pixels in the other of the sets of pixel pairs.

6. The method according to claim 1, wherein obtaining the first voltage signal and the second voltage signal according to the frame input signal and the predetermined rule comprises:

obtaining the first voltage signal and the second voltage signal corresponding to each of the sub-pixels according to a frame-input-signal look-up-table.

7. The method according to claim 1, wherein the display panel comprises red pixels, green pixels and blue pixels, and dividing the pixels with same one color on the display panel into the plurality of sets of pixel pairs comprises: dividing the red pixels on the display panel into a plurality of sets of red pixel pairs, dividing the green pixels into a plurality of sets of green pixel pairs, and dividing the blue pixels into a plurality of sets of blue pixel pairs.

8. The method according to claim 1, wherein the display panel comprises red pixels, green pixels, blue pixels and yellow pixels, and dividing the pixels with same one color on the display panel into the plurality of sets of pixel pairs comprises: dividing the red pixels on the display panel into a plurality of sets of red pixel pairs, dividing the green pixels into a plurality of sets of green pixel pairs, dividing the blue pixels into a plurality of sets of blue pixel pairs, and dividing the yellow pixels into a plurality of sets of yellow pixel pairs.

9. A display device, comprising:

a display panel, wherein pixels with same one color on the display panel is divided into a plurality of sets of pixel pairs, and each of the sets of the pixel pairs comprises a first sub-pixel and a second sub-pixel;

a control member for displaying each frame using two frame images in order, wherein the two frame images comprise a first frame image and a second frame image; and further for obtaining a first voltage signal and a second voltage signal according to a frame input signal and a predetermined rule, wherein the first voltage signal and the second voltage signal correspond to each of the sub-pixels and are unequal to each other, the first voltage signal and the second voltage signal alternately drive a positive-viewing-angle mixed brightness of the sub-pixel to be equivalent to a positive-viewing-angle brightness of the sub-pixel driven by the frame input signal; and a driving member connected to the control member and the display panel for driving the first sub-pixel of the first frame image by the first voltage signal of the first sub-pixel or the second sub-pixel, and driving the second sub-pixel of the first frame image by the second voltage signal of the first sub-pixel or the second sub-pixel; and further for driving the first sub-pixel of the second frame image by the second voltage signal of the first sub-pixel or the second sub-pixel, and driving the second sub-pixel of the second frame image by the first voltage signal of the first sub-pixel or the second sub-pixel.

10. The display device according to claim 9, wherein the first sub-pixel and the second sub-pixel on the display panel are disposed on the same row and neighbor upon each other.

11. The display device according to claim 10, wherein the first sub-pixels in one of the sets of the pixel pairs of the neighboring two sets of pixel pairs in the same column on the display panel neighbor upon the second sub-pixels in the other of the sets of pixel pairs.

12. The display device according to claim 9, wherein the first sub-pixel and the second sub-pixel on the display panel are disposed in the same column and neighbor upon each other.

13. The display device according to claim 12, wherein the first sub-pixels in one of the sets of the pixel pairs of the neighboring two sets of pixel pairs in the same row on the display panel neighbor upon the second sub-pixels in the other of the sets of pixel pairs.

14. The display device according to claim 9, wherein the control member further comprises a looking unit obtaining the first voltage signal and the second voltage signal according to a frame-input-signal look-up-table, wherein the first voltage signal and the second voltage signal alternately drive the positive-viewing-angle mixed brightness of the sub-pixel to be equivalent to the positive-viewing-angle brightness of the sub-pixel driven by the frame input signal.

15. The display device according to claim 9, wherein the display panel comprises red pixels, green pixels and blue pixels, the red pixels on the display panel comprise a plurality of sets of red pixel pairs, the green pixels comprise a plurality of sets of green pixel pairs, and the blue pixels comprise a plurality of sets of blue pixel pairs.

16. The display device according to claim 9, wherein the display panel comprises red pixels, green pixels, blue pixels and yellow pixels, the red pixels on the display panel are divided into a plurality of sets of red pixel pairs, the green pixels are divided into a plurality of sets of green pixel pairs, the blue pixels are divided into a plurality of sets of blue pixel pairs, and the yellow pixels are divided into a plurality of sets of yellow pixel pairs.

17. A driving method of a display panel, comprising:

dividing pixels with same one color on the display panel into a plurality of sets of pixel pairs, wherein each of the sets of the pixel pairs comprises a first sub-pixel and a second sub-pixel neighboring upon the first sub-pixel; and the first sub-pixel and the second sub-pixel are disposed in the same row and neighbor upon each other, or the first sub-pixel and the second sub-pixel are disposed in the same column and neighbor upon each other;

displaying each frame using two frame images in order, wherein the two frame images comprise a first frame image and a second frame image;

obtaining a first voltage signal and a second voltage signal according to a frame input signal and a predetermined rule, wherein the first voltage signal and the second voltage signal correspond to each of the sub-pixels and are unequal to each other, the first voltage signal and the second voltage signal alternately drive a positive-viewing-angle mixed brightness of the sub-pixel to be equivalent to a positive-viewing-angle brightness of the sub-pixel driven by the frame input signal; and driving the first sub-pixel of the first frame image by the first voltage signal of the first sub-pixel or the second sub-pixel, and driving the second sub-pixel of the first frame image by the second voltage signal of the first sub-pixel or the second sub-pixel; and driving the first sub-pixel of the second frame image by the second voltage signal of the first sub-pixel or the second sub-pixel, and driving the second sub-pixel of the second frame image by the first voltage signal of the first sub-pixel or the second sub-pixel.

* * * * *